US009510625B2

(12) United States Patent
Henderson

(10) Patent No.: US 9,510,625 B2
(45) Date of Patent: Dec. 6, 2016

(54) TWO-TAB CUFF CLOSURE

(71) Applicant: Cecelia Henderson, Dumfries, VA (US)

(72) Inventor: Cecelia Henderson, Dumfries, VA (US)

( * ) Notice: Subject to any disclaimer, the term of this patent is extended or adjusted under 35 U.S.C. 154(b) by 80 days.

(21) Appl. No.: 14/603,301

(22) Filed: Jan. 22, 2015

(65) Prior Publication Data

US 2016/0213069 A1 Jul. 28, 2016

(51) Int. Cl.
*A41B 7/02* (2006.01)
*A44B 1/00* (2006.01)
*A41B 7/00* (2006.01)

(52) U.S. Cl.
CPC .. *A41B 7/02* (2013.01); *A44B 1/00* (2013.01)

(58) Field of Classification Search
CPC ..... A41B 7/02; A41B 7/04; A41B 7/12; A41B 7/00; A41D 27/10; A41D 15/002; A41D 27/08
See application file for complete search history.

(56) References Cited

U.S. PATENT DOCUMENTS 20,634 A 3/1891 Lewis
24,870 A 11/1895 Smock
1,465,625 A * 8/1923 Cragin ..... A41B 7/04 2/123
2,428,158 A * 9/1947 Hermer ..... A41B 7/02 2/124
3,111,682 A * 11/1963 Swinney ..... A41D 27/10 2/270
3,137,861 A * 6/1964 Sanders ..... A41B 7/04 2/123
D341,921 S * 12/1993 Trost ..... D2/858
6,430,747 B1 * 8/2002 Lee ..... A41B 7/00 2/123
7,380,287 B2 * 6/2008 DeSantis ..... A41D 27/10 2/123
D576,377 S * 9/2008 Galasso ..... D2/858
D576,378 S * 9/2008 Galasso ..... D2/858
D584,883 S * 1/2009 Galasso ..... D2/858
7,748,058 B2 * 7/2010 Steitle ..... A41D 1/06 2/232
7,962,969 B1 * 6/2011 Blakely ..... A41B 7/02 2/123
D640,859 S * 7/2011 Njoku ..... D2/858
9,009,865 B2 * 4/2015 Gilreath ..... A41B 7/02 2/123
9,009,866 B2 * 4/2015 Blakely ..... A41B 7/10 2/124
2005/0172379 A1 * 8/2005 Bush ..... A41B 11/125 2/123
2014/0090144 A1 * 4/2014 Gilreath ..... A41B 7/02 2/69
2014/0165260 A1 * 6/2014 Harding ..... A41B 7/12 2/123

OTHER PUBLICATIONS

"High 2 tabs cuff" Bivolino.com.

* cited by examiner

*Primary Examiner* — Bobby Muromoto, Jr.
(74) *Attorney, Agent, or Firm* — Richard C. Litman

(57) ABSTRACT

The two tab cuff closure is a closure for the sleeve(s) of a shirt. The two tabs are positioned on one edge of the cuff and will connect to fasteners that are positioned on the opposing cuff edge. The double tab design ensures that the cuff fabric will lay flat and not pucker or bulge. The tab structure arrangement could be adapted for utilization with cuff links or buttons.

5 Claims, 4 Drawing Sheets

TWO-TAB CUFF CLOSURE

BACKGROUND OF THE INVENTION

1. Field of the Invention

The present invention generally relates to wearing apparel, and particularly to a two-tab cuff closure for a shirt.

2. Description of the Related Art

The goal of substantially all shirt makers is to make a perfectly fitting garment. Tapering the sleeve and waistline or shaping the collar to secure a more aesthetically pleasing look are innovations that have been applied to make the shirt fit better. Heretofore, the cuff of the shirt has not demanded very much attention. Most cuffs are designed with a single fastener, and more often than not will not lay completely flat when fastened, thus showing unsightly puckers and bulges. A fix for these problems would certainly be welcomed in the garment industry. Thus, a two-tab cuff closure solving the aforementioned problems is desired.

SUMMARY OF THE INVENTION

The two tab cuff closure is a closure for the sleeve(s) of a shirt. The two tabs are defined on one edge of the cuff and have buttonholes therein that will connect to fasteners (normally buttons) that are positioned on the opposing cuff edge. The double tab design ensures that the cuff fabric will lay flat and not pucker or bulge. A second embodiment of the invention shows the tab structure arrangement adapted for utilization with cuff links or buttons.

Accordingly, the invention presents a unique shirt cuff arrangement utilizing tabs to fasten the opposing edges of the cuff. Each cuff is of one-piece design with the tabs unitary therewith. The tabs overlap the opposing edge of the cuff when fastened. Although a single tab may be employed, it has been determined that a double tab is more efficient in attaining a more aesthetically pleasing closure. The invention provides for improved elements thereof in an arrangement for the purposes described that are inexpensive, dependable and fully effective in accomplishing their intended purposes.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
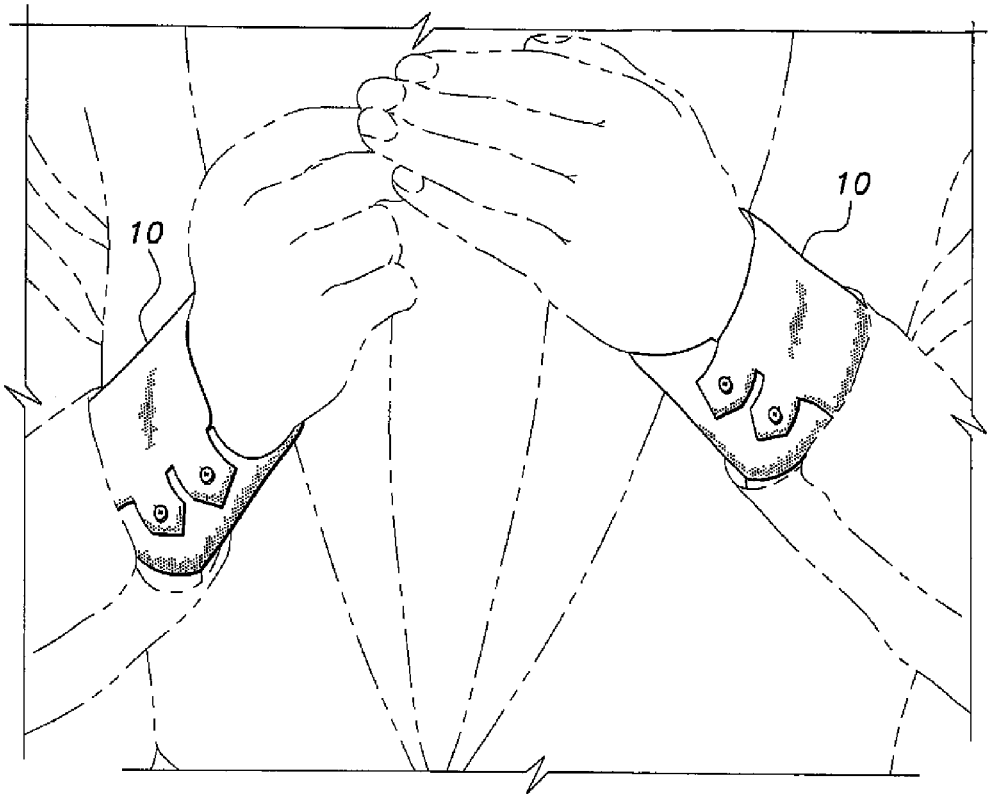
FIG. 1 is an environmental, perspective view of a two-tab cuff closure according to the present invention.
Figure 2:
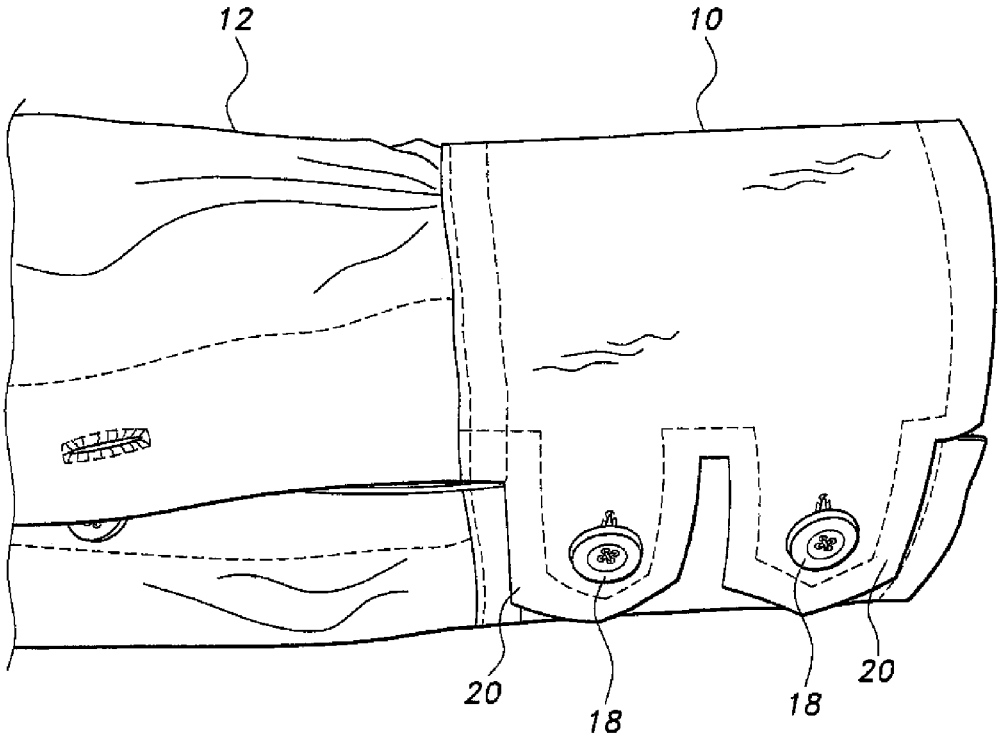
FIG. 2 is a partial, perspective view of a two-tab cuff closure according to the present invention.
Figure 3:
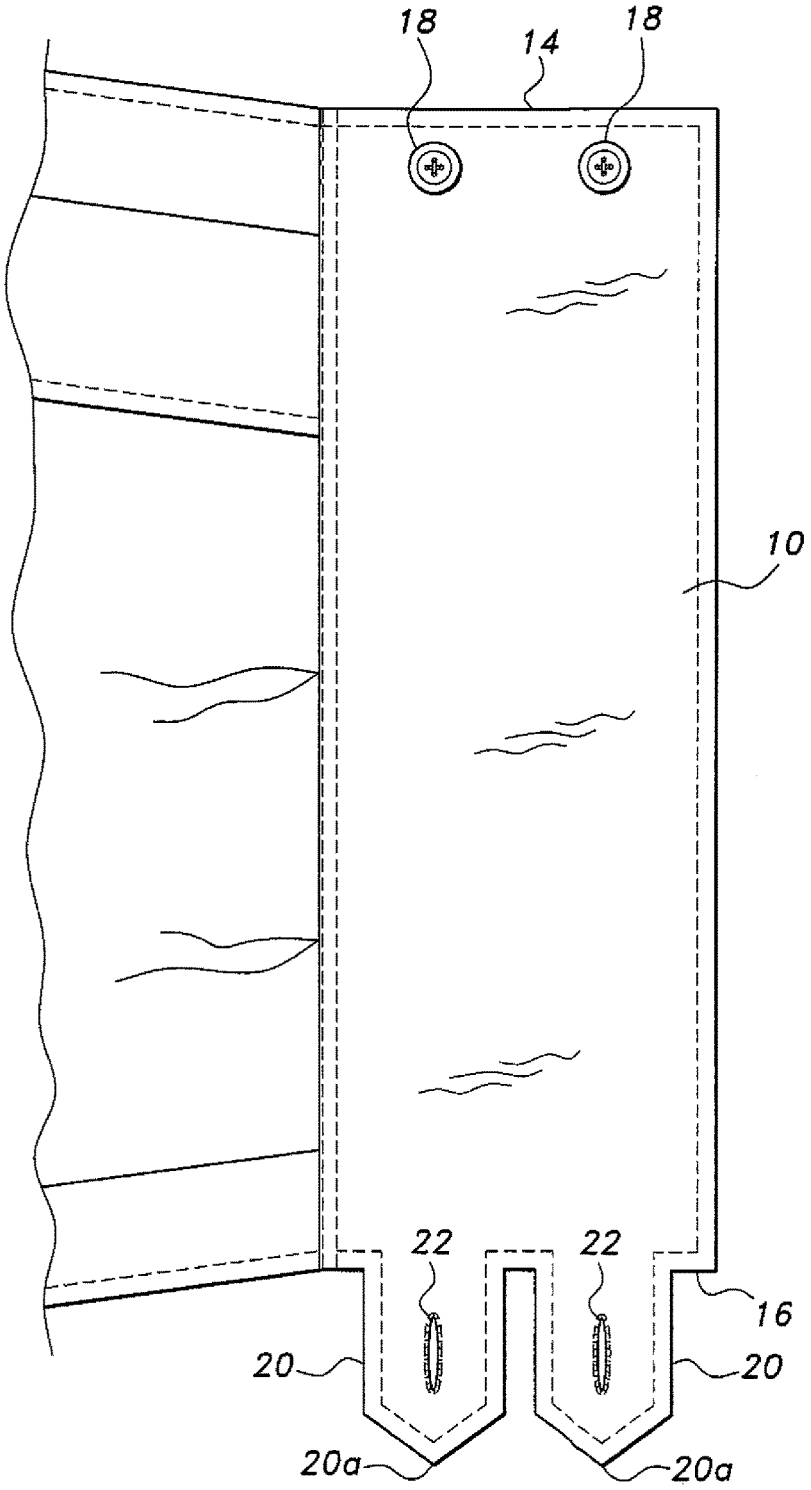
FIG. 3 is a partial top view of a two-tab cuff closure according to the present invention.

Referring to FIGS. 1-3, the two-tab cuff closure 10 includes a cuff assembly permanently secured to the end of a shirtsleeve 12 in a conventional manner. The cuff 10 comprises an elongate fabric strip having respective first and second edges 14 and 16. A pair of fasteners 18 is secured to the top surface of the cuff 10 adjacent edge 14 and laterally spaced on opposite sides of a longitudinal axis extending from one end 14 to the other end 16 between the tabs 20 so that one fastener 18 is more proximal to the shirtsleeve 12 than the other fastener 18, i.e., the fasteners 18 are aligned vertically, rather than horizontally. A pair of tabs 20 extends from edge 16. The cuff 10 and tabs 20 are unitary being fabricated from one piece. Each tab 20 is designed with a respective free end 20*a*. In the embodiment shown, the free end is of a V-shaped configuration. It should be noted, however, that other aesthetically pleasing designs (semicircular, orthogonal, etc.) may be employed if desired. Each tab 20 has a respective opening (or buttonhole) 22 defined therein, which is spaced a predetermined distance from the end 20*a* of the tab. When the cuff 10 is fastened, as best seen in FIGS. 1 and 3, the edges 14, 16 abut (no overlap) and the tabs on edge 16 overlap edge 14 so that the fasteners 18 may be inserted in openings 22. This arrangement permits the cuff to lie flat, without bulging or puckering.

Figure 4:
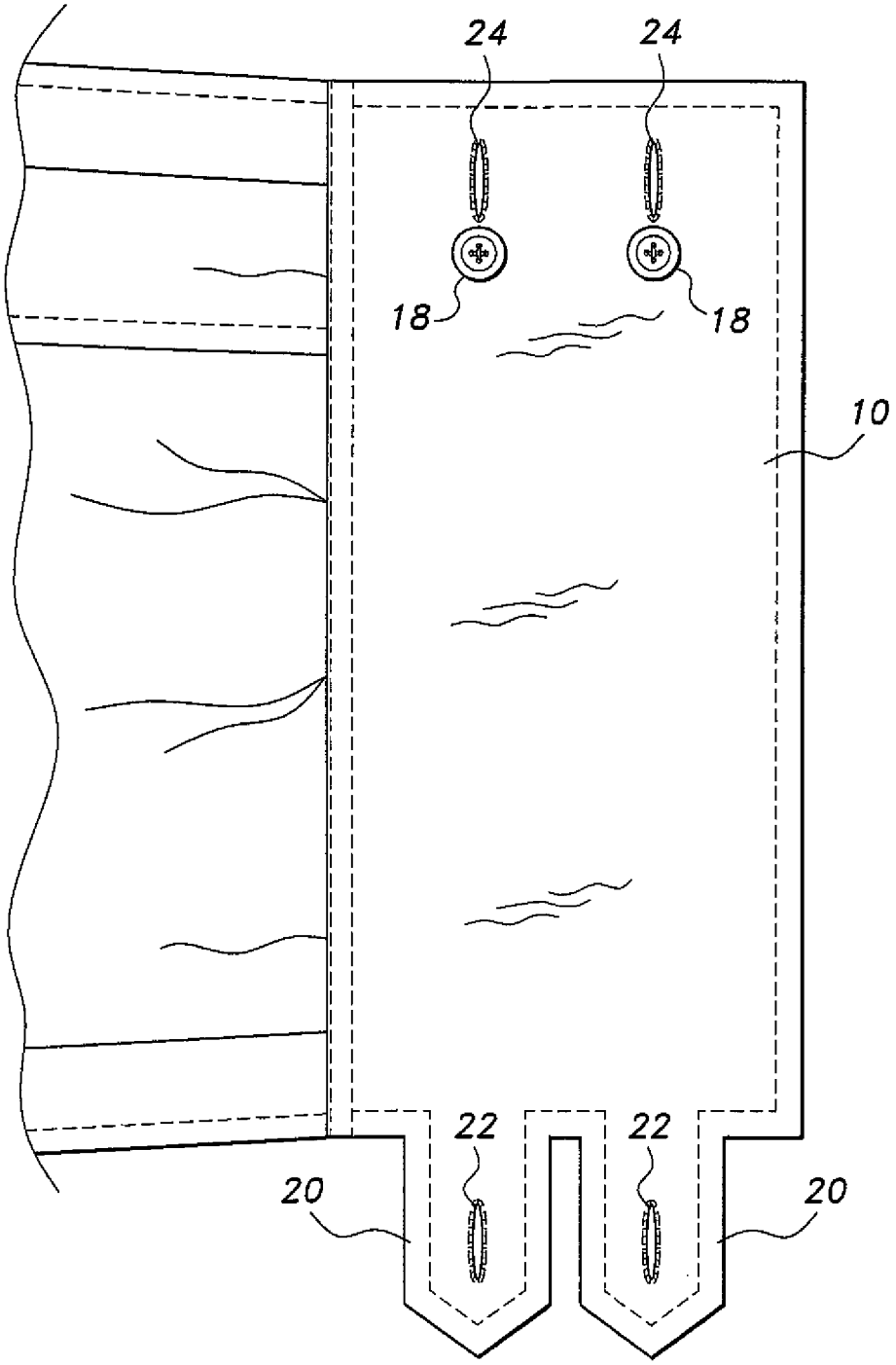
FIG. 4 is a partial top view of a second embodiment of a two-tab cuff closure according to the present invention having buttonholes at opposite ends for receiving cuff links.

FIG. 4 shows a second embodiment of the two-tab cuff closure designed to allow the use of cuff links (not shown). This embodiment employs a pair of apertures 24 adjacent to edge 14. Fasteners 18 are positioned adjacent apertures 24. This arrangement permits a user to employ cuff links or button fasteners, as desired, to secure the cuffs.

The two-tab cuff closure 10 may be furnished as an aftermarket notion or accessory that can be sewn onto the end of a sleeve to replace the existing cuff, or may be incorporated into a shirt as part of the original design.

It is to be understood that the present invention is not limited to the embodiments described above, but encompasses any and all embodiments within the scope of the following claims.

I claim:

1. A combination of a shirt and a cuff closure therefore, consisting of:

a shirt, the shirt including a pair of sleeves, each of the sleeves having a slit at an end portion thereof;

a cuff member, the cuff member having opposed sides and opposing first and second edges, wherein one of the sides is attached to the end of the shirt sleeve;

a plurality of spaced apart tab members extending solely from the second edge and occupying substantially the entire second edge, each of the tab members having an opening defined therein, wherein the plurality of tabs and the cuff member are of one-piece construction; and means adjacent the first edge for securing the tab members thereto so that the first edge and the second edge lie solely in a flat, abutting relationship without any overlapping or bulging of the first and second edges.

2. The combination of a shirt and cuff closure according to claim 1, wherein each said tab member has a free end and wherein each said opening is positioned adjacent the free end.

3. The combination of a shirt and cuff closure according to claim 1, wherein said means for securing comprises button fasteners, the button fasteners are positioned on the top surface of said cuff member.

4. The combination of a shirt and cuff closure according to claim 1, wherein said means for securing includes apertures formed through said cuff member for receiving cuff links therethrough.

5. The combination of a shirt and cuff closure according to claim 1, wherein the plurality of tab members is two.

* * * * *